United States Patent [19]

Inada

[11] 4,009,710

[45] Mar. 1, 1977

[54] ELECTROMASSAGER

[76] Inventor: Nichimu Inada, 4-25, Morofuku 5-chome, Daito, Osaka, Japan

[22] Filed: July 10, 1975

[21] Appl. No.: 594,948

[30] Foreign Application Priority Data

July 11, 1974 Japan ..... 49-79359

[52] U.S. Cl. ..... 128/44; 128/55; 128/57

[51] Int. Cl.[2] ..... A61H 7/00

[58] Field of Search ..... 128/44, 48, 49, 51–55, 128/24.2, 33, 57

[56] References Cited

UNITED STATES PATENTS

| | | | |
|---|---|---|---|
| 2,874,689 | 2/1959 | Gavelek | 128/33 |
| 3,633,571 | 1/1972 | Shinagawa et al. | 128/44 |
| 3,640,272 | 2/1972 | Hussey | 128/57 |
| 3,800,785 | 4/1974 | Inada | 128/55 |

*Primary Examiner*—Lawrence W. Trapp

[57] ABSTRACT

An electromassager for massaging action which includes a mechanism means for obtaining simultaneously both horizontally massaging movement along various locus and vertical tapping movement.

3 Claims, 9 Drawing Figures

ELECTROMASSAGER

This invention relates to a new and improved electromassager.

BACKGROUND OF THE INVENTION

This invention relates broadly to the field of a massage apparatus and particularly to electromassager having massaging balls to drive horizontally along various locations while tapping vertically simultaneously.

Well known prior apparatus for massaging have provided one or two pairs of massaging balls which protruded at the back of a chair, which massaging balls have been vibrated along solely a straight line, one of horizontal or vertical, in order to massage the shoulders, the back, the waist, or other parts of the body. Namely, it has been desired the balls have a simple and regular vibrating movement, and therefore, it has been impossible to expect both kneading and massaging operating by prior apparatus, other than by hand, since the operation and effect of the apparatus against the body has been limited; also there has not been previously provided a mechanism for treating different parts of the body from various locations by variable repositioning movement of the massaging and tapping element in the prior apparatus.

THE INVENTION

The present electromassager is adapted for eccentric cams and swing plates which are driven at different speeds and urge selectively two movements of different sorts to the massaging balls thereby causing the massaging balls to move along various different planes of movements. In particular, when the electromassager is driven, it is possible to obtain complex movements of strong-and-faint, up-and-down, and right-and-left movements, in addition to simultaneously bitingly kneading and fast rubbing movements by control of the speed on the massaging balls. Accordingly, objects of the invention are to make possible therapy of diverse different affected parts of the body in accordance with massage of the shoulders, the back, the waist, and other parts of the body, and facilitation of the circulation of the blood, and relief of the stiffness, in addition to obtaining simultaneous massaging and tapping actions.

Another object of the present invention is to provide a new and improved electromassager.

A further object of the present invention is to provide an improved driven means for the massaging balls selectively urged in two distinct separately controllable movements of different sorts.

The size of the restriction necessary can be determined empirically for each embodiment of the electromassager.

This invention possesses many other advantages, and has other purposes which may be made more clearly apparent from a consideration of the form in which it may be embodied. This form is shown in the drawings accompanying and forming parts of the present specification. It will now be described in detail, for the purpose of illustrating the general principals of the invention; but it is to be understood that such detailed description does not limit the invention, since the scope of the invention is disclosed herein as claimed.

THE FIGURES

An embodiment of the present invention will now be described in detail with respect to the drawings wherein: FIG. 1 is a front elevation view showing a preferred embodiment of the principal mechanism diagrammatically;

Figure 6:
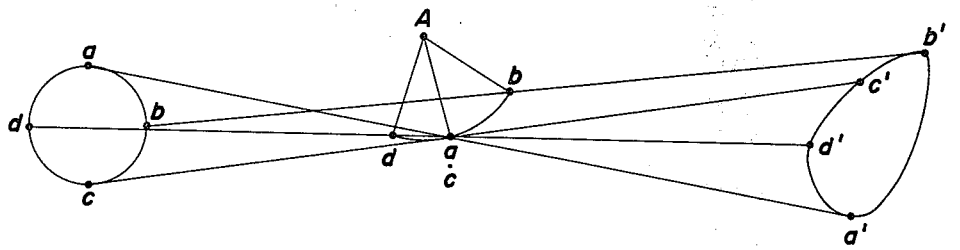
Figure 7:
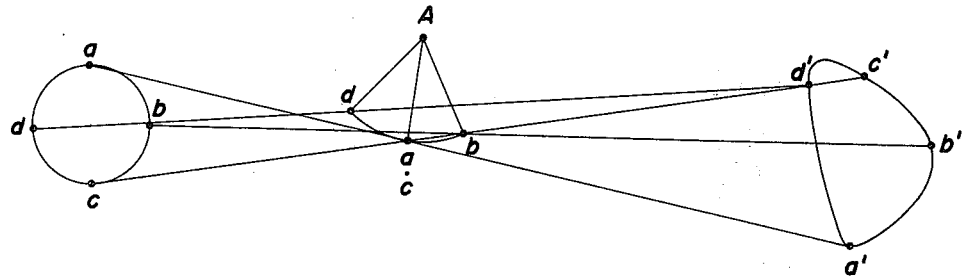
Figure 8:
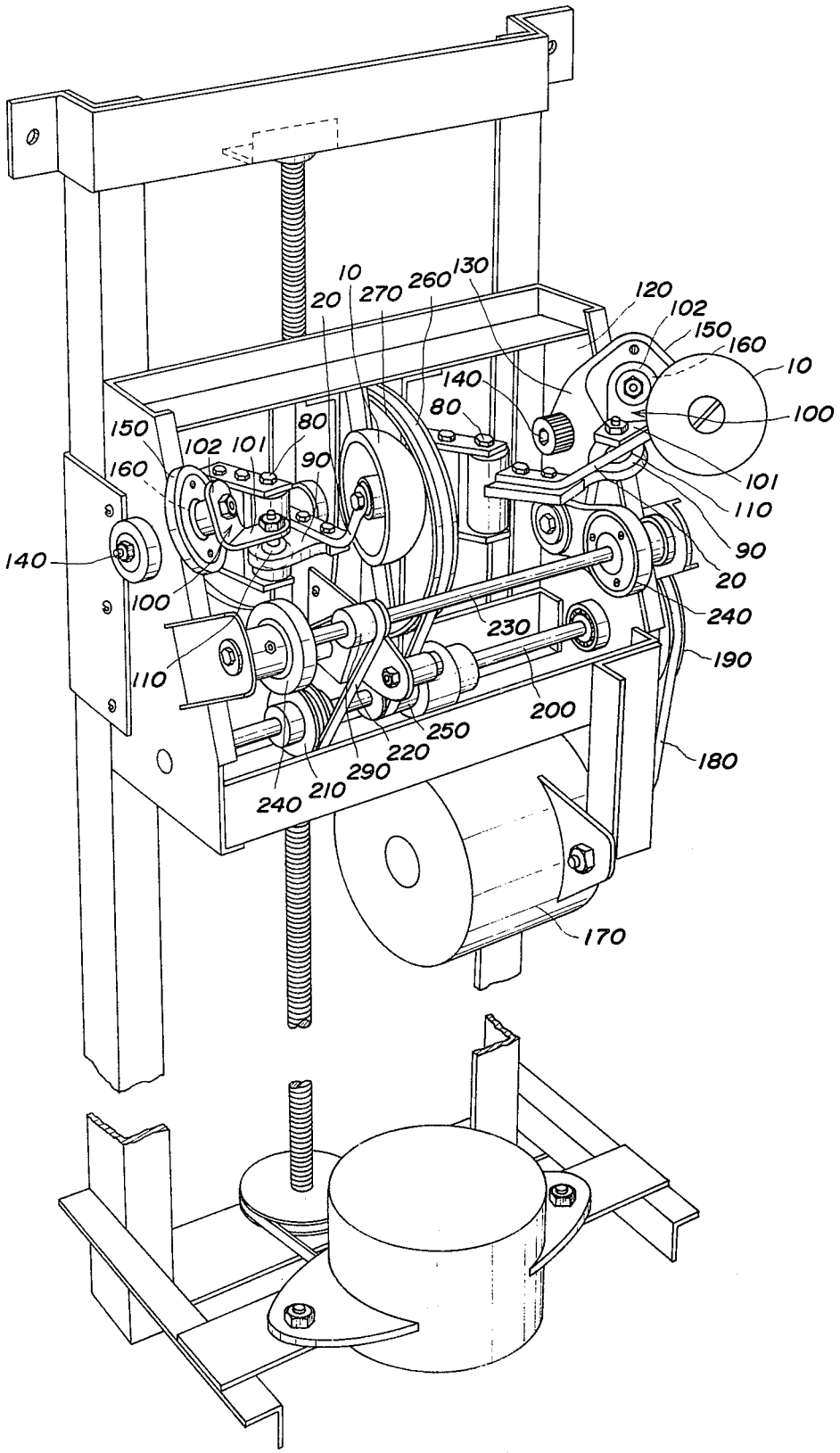
Figure 9:
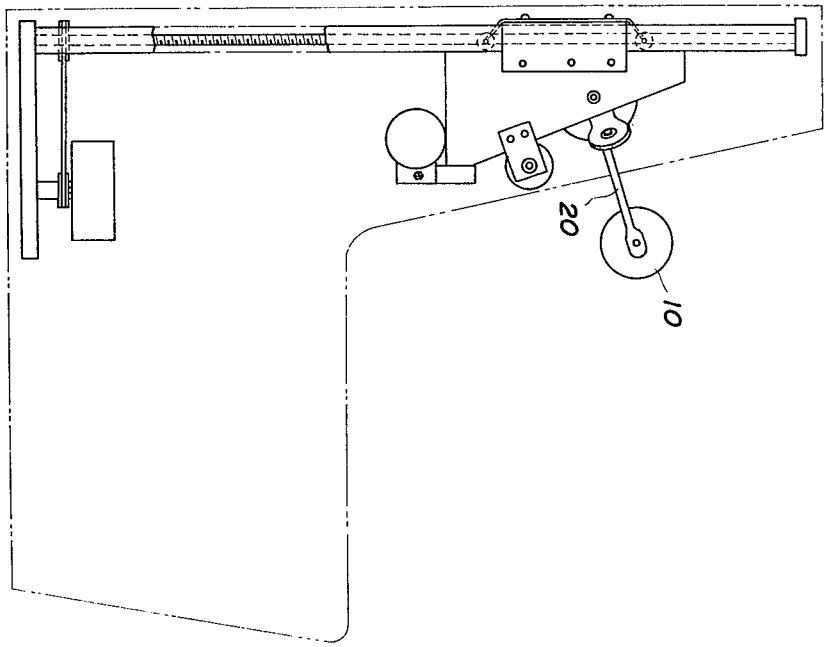

As FIG. 6 and 7 shows other movement parameters when the positions of the spherical bearings are changed;

FIG. 8 is a perspective view showing another embodiment;

FIG. 9 is a side view of a chair electromassage, showing the chair in phantom with the mechanism mounted therein;

DESCRIPTION OF THE PREFERRED EMBODIMENT

Figure 3:
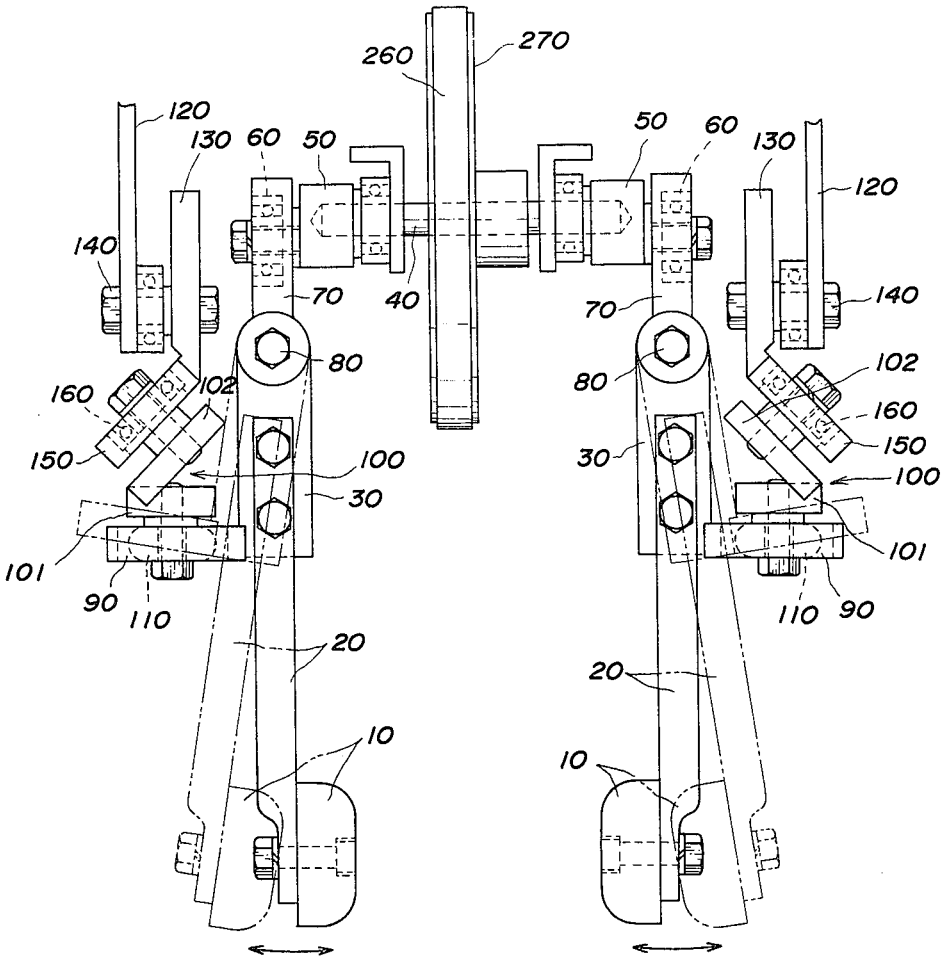
FIG. 3 is an elevation plan view of the FIGS. 1 and 2 embodiment principal mechanism.

The present invention provides symmetrical structures as a pair at the both sides, and the detailed structures are described with regard to one of the pair as in the following description. Referring now to the FIGS. as illustrated in FIG. 3, a pair of the massaging balls 10 are connected to upper ends of a pair of arms 20, and the arms are projected from a driving member which is positioned in the rear of a back seat of a chair so as to drive upwardly or downwardly along two angle bars by clockwise or counter clockwise rotation of threaded shafts.

Base 30 of the arm 20, is supported movably and horizontally on end of drive shaft 70, for kneading operation by pin 80, which pin 80 is connected eccenrically through bearing 60 to eccentric cam 50, fixed with main axis 40 for kneading movement. The arm 20 has projections 90 projected at right angles to and at intermediate part thereof, spherical bearing 110 set on the projection 90, swing plate 130 for tapping operation pivoted vertically amd movably to frame 120, at pivot 140, inclined plate 150 spread outwardly and fixed at an upper end of the swing plate 130, and bearing 160 set in the inclined plate 150. The base of the arm 30 and the swing plate 130 are connected through shift cam 100 which has parallel face 101, against said projection 90 and the inclined plate 150.

Figure 1:
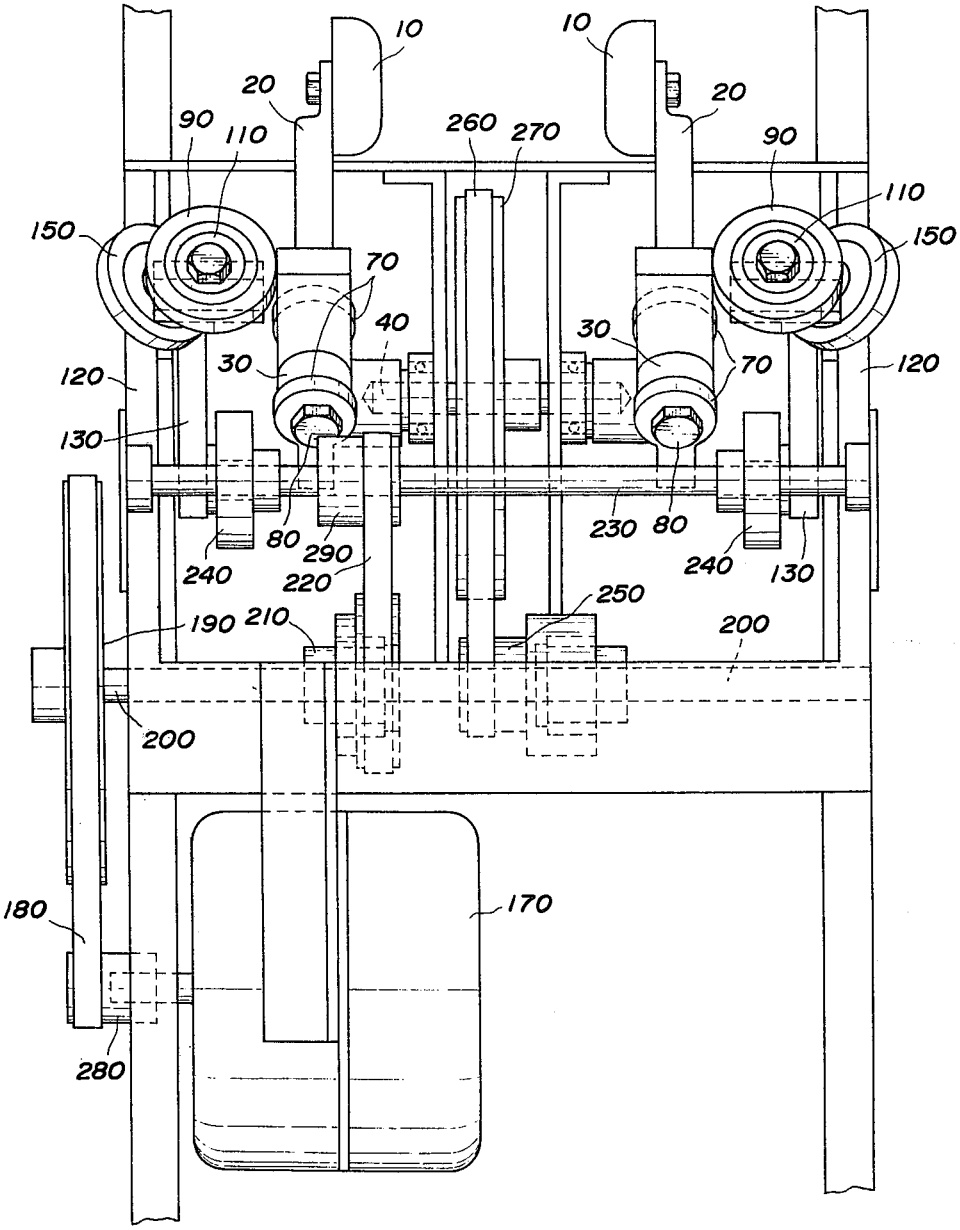
Figure 2:
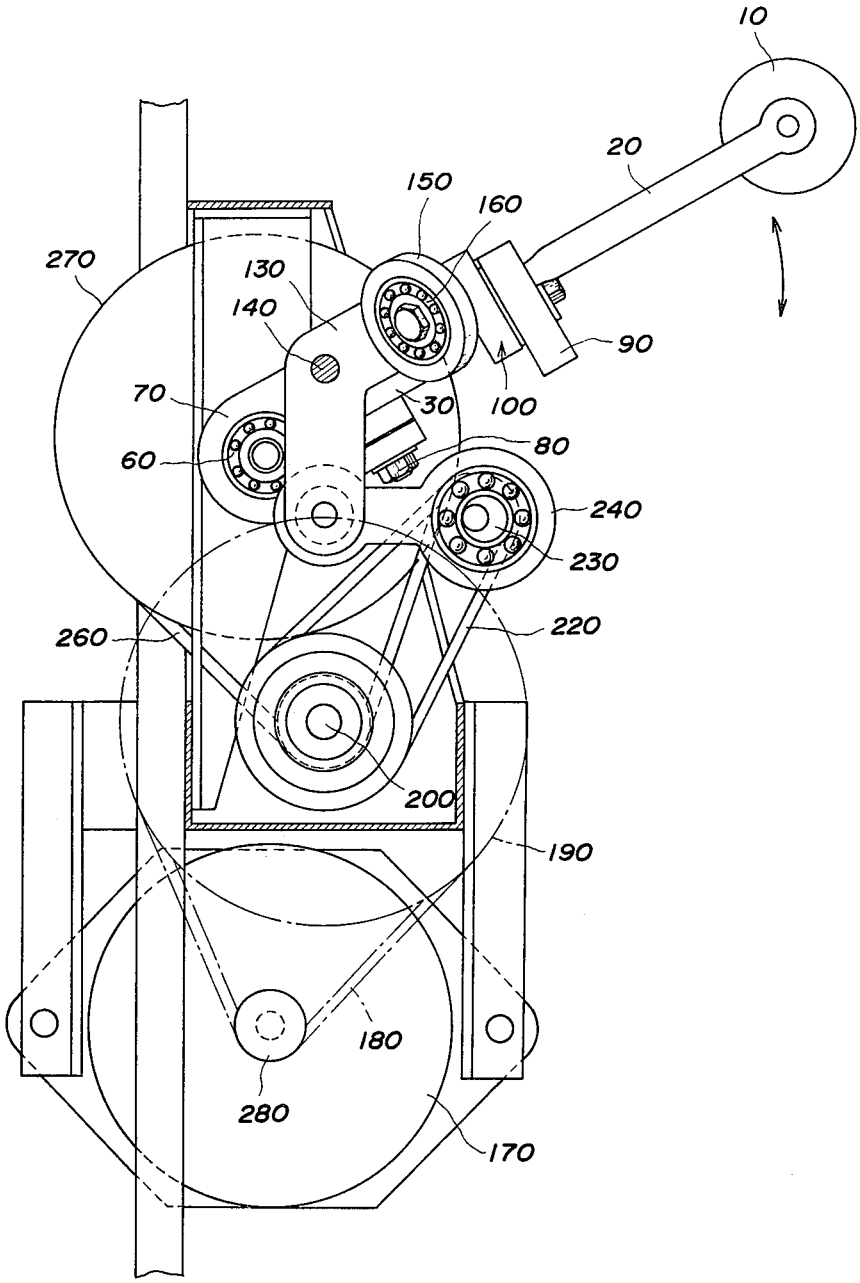
FIG. 2 is a side elevation view of the FIG. 1 embodiment.

As illustrated in FIG. 2, the swing plate 130 is swung at the pivot 140, as fulcrum, by means of a connection at a lower end of swing plate 130, with the other end of the drive shaft 240, for tapping operation which is eccentrically attached to a main axis 230 for tapping movement. The main axis 230 is transmitted rotation through one way rotative belt 220 and pulley 210 having a conventional rotatable crank structure (not shown), the pulley 210 being mounted at about the middle axis 200 which being driven through pulley 190 and belt 180, by driving motor 170. The eccentric cam 50 fixed to ends of the main axis 40 for kneading movement, is driven reversely against the pulley 210 attached to the middle of axis 200, by rotation of a pulley 270 having a large diameter, which the pulley 270 is mounted on axis 40. Axis 40 is rotated by the pulley 270 which is connected through by a belt 260 and a pulley 250 having a rotative conventional drive structure (not shown) and being rotatably mounted at the middle axis 200.

Consequently, by change of rotation of the driving motor, the rotation is selectively transmitted, through the middle axis 200, to one of pulleys 210 or 250, and the rotation is changed to tapping movement, or to complex two movements joining irregularly kneading and rubbing movement.

Figure 4:
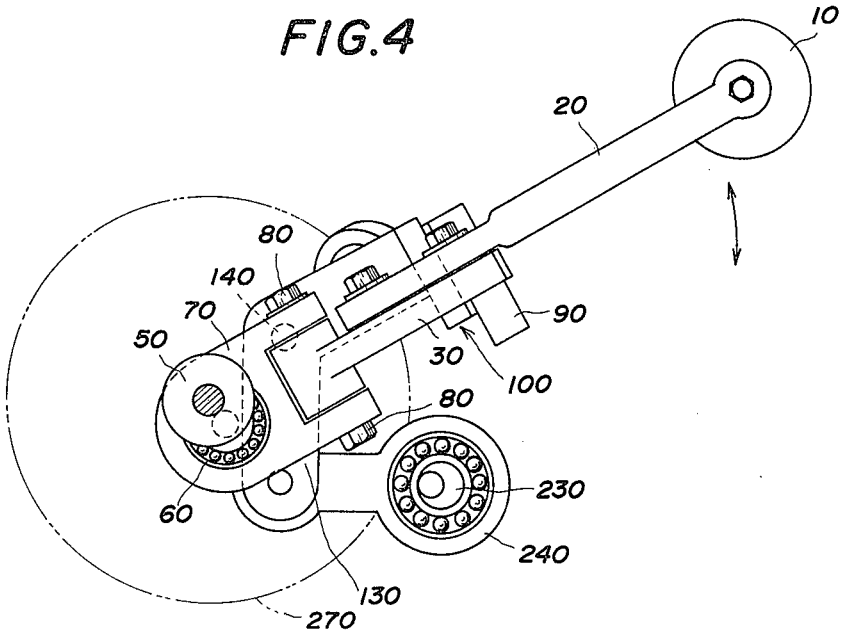
FIG. 4 is an in-part side elevation view of the tapping mechanisms.

Described in greater detail, the small diameter pulley 280 is mounted to the motor shaft 170 and the belt 180 is placed on the pulley 280 and on the large diameter pulley 190 which is mounted at the middle axis 200. The rotation of the driving motor 170 is transmitted to the middle axis 200 through the pulleys 280, 290. When the pulley 210 is rotated by the middle axis 200, a pulley 290 (attached to main axis 230 for tapping movement) is rotated through belt 220, then the rotation is transmitted to the main axis 230 for tapping movement. By movement of the tapping crank 240 eccentrically mounted on the main axis 230 for tapping movement, the swing plate 130 is swung on the fulcrum at the pivot part 140, and the arm connected through shift cams 100 is reciprocally moved upwardly-and-downwardly as shown by the arrow in FIG. 2 and FIG. 4 such that the massaging balls cause tapping movement.

When the rotation is changed and the driving motor 170 is reversely rotated, the pulley 210 being mounted to the middle axis 200 is stopped and swing plate 130 is stopped too and also tapping movement is stopped accordingly.

On the other hand, a slip-clutch of the pulley 250 having been disengaged the change of the rotation of the driving motor 270 causes pulley 250 to be rotated with the middle axis 200, rotation of the pulley 250 being transmitted to the main axis 40 for kneading movement through the belt 260 from the large diameter pulley 270, which the speed of transmitted rotation is different from the rotation for tapping movement. The rotation is changed to crank movement by drive shaft 70 for kneading movement being connected to the eccentric cam 50.

Figure 5:
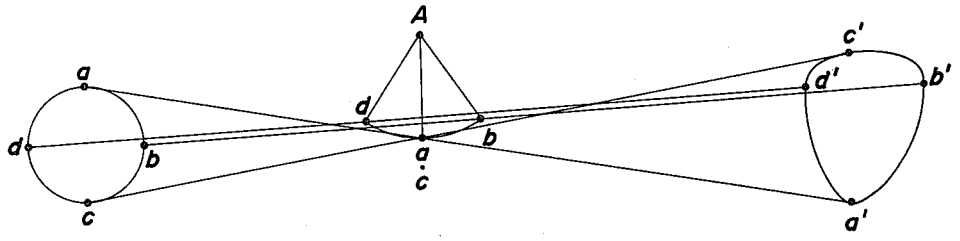
FIG. 5 illustrates diagrammatically the parameters of movement of the massaging balls when driven.

Since the arm is supported at axis member of the bearing 160 as a fulcrum A, which the arm is connected to the bearing 160 through the spherical bearing 110 and the shift cam 100, as shown in FIG. 5, when the connection part of the eccentric cam 50 of the drive shaft 70 rotates through each of the points *a*, *b*, *c* and *d*, the massaging ball of the end of the arm 20 is moved along its parameters of movement, being joined at points *a'*, *b'*, *c'*and *d'*. Since base 30 of the arm 20 is supported to the end of drive shaft 70 by pin 80 so as to move horizontally when the drive shaft 70 for kneading movement is at the point b the arm 20 is controlled at the spherical cam 110 so as to be located as the most distant portion between the both massaging balls 10 as illustrated by a dotted line in FIG. 3. And, when it is at the point *d*, the arm is moved to right-or-left so as to shorten the distance between the both balls as shown by the arrows, the massaging ball is moved vertically and horizontally along the complex locus.

As shown in FIG. 5, when it is shown from side portion, the ball is slowly moved between two points of *b'*, and *c'*than the points *a'*and *b'*, also it is most slowly moved between the points of *c'*and *d'*, consequently, it is formed the irregular and ununiformed locus being linked up to the points *a'*, *b'*, *c'*and *d'*.

Therefore, when the massaging ball is slowly moved, there is expected massaging effect; and when the ball is quickly moved, there is expected rubbing movement in addition to kneading effect. Also there is expected simultaneously both strong and weak varying titillation. If the distance between supported portion of the drive shaft 70 for kneading operation and the spherical bearing 110 of the arm 20 is changed, there can be obtained other random and non-uniformed parameters of movement as shown in FIG. 6 and FIG. 7 as compared with the parameters shown in FIG. 5.

In FIG. 8 there is shown another embodiment of the present invention in which the projection 90 is connected vertically to the parallel face 101 of the shift cam 100 through the spherical bearing 110, by which it is possible to obtain the same massage effect.

As above described, the present invention adapted for eccentric cams and swing plates which are driven under variably different speeds and which urge selectively two movements of different sorts to the massaging balls, causing the massaging balls to move along various planes and parameters. Particularly, when the electromassager is driven, it is possible to obtain various complex movement and operation of bitingly kneading and fast rubbing movements by control of the speed on the balls. Thus, it is possible to promote the therapy of the affected parts of the body such as massage of the shouler, the back, the waist, and other parts of the body to facilitate circulation of the blood and relieve stiffness.

I claim:

1. An electromassager device comprising in combination: a support structure; a reversible drive means for imparting a driving force, mounted on the support structure; a massaging means mounted on the support structutre, drivably connected to the drive means and for massaging function and including arm elements, a separate massaging ball being attached at an end portion of each one of the arm elements, a projection extending outwardly from a middle portion of each arm element, drive shafts connected to be driven by the drive means, a separate slip-clutch gear separately driven one by each of said drive shafts and thereby adapted to drivably impart a tapping movement, and a separate eccentrically mounted cam in operative association with each shaft and slip-clutch gear thereof, said eccentrically mounted cams being drivable through its respective slip-clutch gear, and a base of each arm being positioned for movement in a vertical direction mounted on an end of one of the drive shafts for each arm element, each respective arm element being mounted on one of the cams, at least one arm element per cam, the support structure having side plates; and swing plates, inclined plates, and shift cams, each said projection being mounted on the side plates by spherical bearings and connected thereby to the inclined plates, the inclined plates being affixed to the swing plates by connection through the shift cams, said shift cams being pivotably mounted on the support structure and positioned for movement along a substantially upright plane substantially parallel to flat faces of the side plates of the frame; and the reversible drive means further providing for optional alternate movements forwardly or reversibly of said drive shafts adapted for thereby movement of the swing plates to give the tapping movement, and for alternately reversibly giving movement in varying planes and speeds of massaging movements of the massaging balls whereby the massaging balls are movable along varying planes and parameters.

2. An electromassager device of claim 1, in which the arm elements each include symmetrical structures mounting a respective one of the massaging balls adapted such that both tapping and massaging movements are obtainable by movement in diverse planes for each said massaging ball.

3. An electromassager device of claim 1, in which inclined plates are connected to the arm elements by the shift cams and connected to the shift plates pivotably at the middle portion of the respective arm elements, and a lower end of each arm element being connected to the eccentrically mounted cam shafts.

* * * * *